United States Patent [19]

Keefe

[11] 4,050,376

[45] Sept. 27, 1977

[54] SELECTIVE PRINTING APPARATUS

[75] Inventor: Jack D. Keefe, Dayton, Ohio

[73] Assignee: Monarch Marking Systems, Inc., Dayton, Ohio

[21] Appl. No.: 541,962

[22] Filed: Jan. 17, 1975

Related U.S. Application Data

[63] Continuation of Ser. No. 406,532, Oct. 15, 1973, abandoned.

[51] Int. Cl.[2] ..... B41J 1/20

[52] U.S. Cl. ..... 101/111

[58] Field of Search ..... 101/111, 93.14, 105

[56] References Cited

U.S. PATENT DOCUMENTS

| | | | |
|---|---|---|---|
| 2,193,564 | 3/1940 | Melind | 101/111 |
| 2,762,297 | 9/1956 | Baer | 101/111 X |
| 2,950,048 | 8/1960 | Luhn | 101/111 X |
| 3,128,697 | 4/1964 | Clausing | 101/111 |
| 3,164,086 | 1/1965 | Keck | 101/111 |
| 3,418,929 | 12/1968 | Nelson | 101/111 |
| 3,628,453 | 12/1971 | Jackson et al. | 101/111 |
| 3,744,411 | 7/1973 | Becker | 101/111 |
| 3,796,152 | 3/1974 | Finke et al. | 101/105 X |

*Primary Examiner*—Edward M. Coven
*Attorney, Agent, or Firm*—Joseph J. Grass

[57] ABSTRACT

There is disclosed selective printing apparatus comprising a stationary support, a drive wheel having both notches and knurling at its peripheral surface, and a printing band having a printing section and a non-printing human readable section the printing section having printing characters at its outer surface, and the human readable section having corresponding human readable indicia on its outer surface and lugs on its underside cooperable with the notches in the wheel. In one embodiment the printing section has knurling on its underside cooperable with the knurling on the wheel. In other embodiments, knurling on the wheel is cooperable with the smooth underside of the printing section.

29 Claims, 10 Drawing Figures

FIG-7
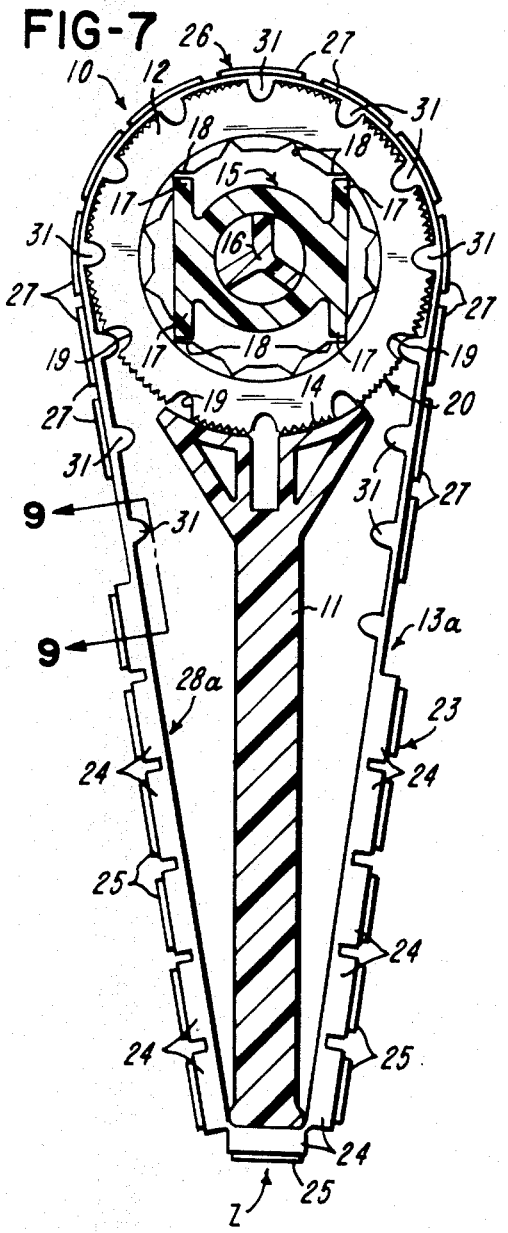
FIG-8
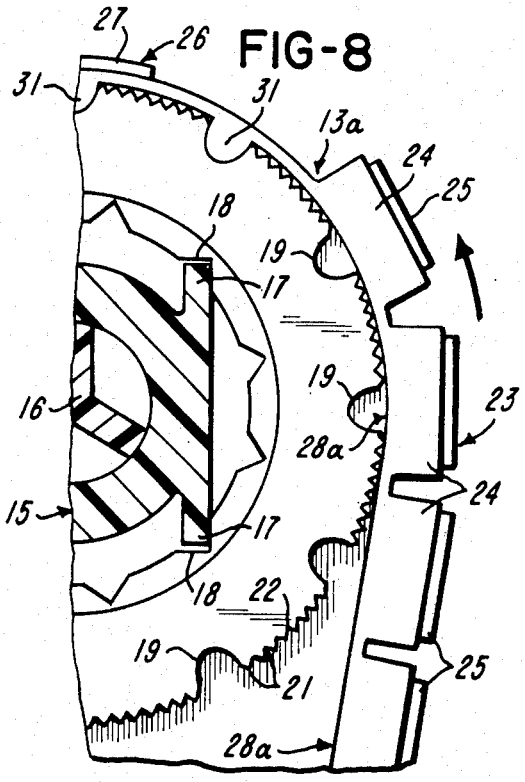
FIG-9
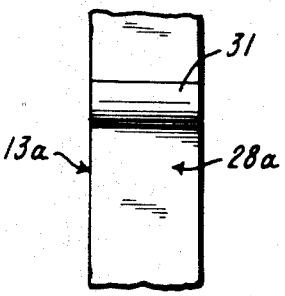
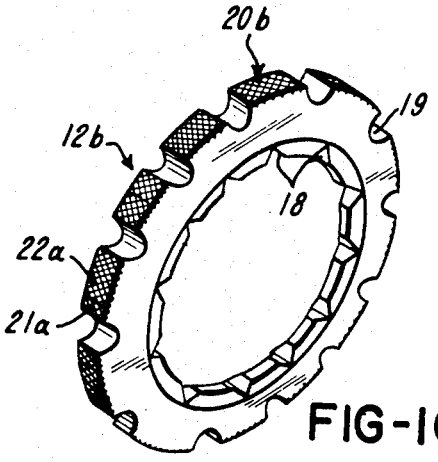
FIG-10

SELECTIVE PRINTING APPARATUS

This is a continuation of application Ser. No. 406,532, filed Oct. 15, 1973, now abandoned.

BACKGROUND OF THE INVENTION

1. Field of the Invention

This invention relates in general to the art of selective printing apparatus.

2. Brief Description of the Prior Art

Prior art selective printing apparatus have employed unitary endless printing bands having a printing section and a non-printing human readable section with lugs on the underside of the printing band as disclosed in Canadian Pat. No. 653,495. Typical apparatus have printing bands with between about three and seven lugs per inch of band length. Other known printing bands have 33⅓ lugs per inch of band length with a diamond knurl on the drive wheel to drive the printing band about a rotatably mounted square support wheel. U.S. Pat. No. 3,418,929 discloses a printing band with twenty lugs per inch. A printing band with no lugs on its underside is disclosed in U.S. Pat. No. 685,474. Another printing band is disclosed in U.S. Pat. No. 3,744,411 as having lugs only on a non-printing section of the printing band; this patent also discloses the provision of abutments to limit the rotation of the drive wheel. Notwithstanding the provision of abutments or other means designed to prevent the user from advancing the band to a position in which the non-printing section is brought to the support at the printing zone, some users may attempt to advance the band to this position forceably by applying undue force to the selector and this can cause damage to the apparatus.

Many of the acceptable printing bands used in commercial printing apparatus have relatively large lugs similar to the ones shown in Canadian Pat. No. 653,495, wherein the printing band passes under tension about a generally annular drive wheel and a square support wheel. To provide lower manufacturing cost for such apparatus, some commercial apparatus have used a stationary support rather than a square support wheel. While the relatively large lugs will effect excellent traction between the printing band and the drive wheel, the tension in the printing band increases each time the printing band is advanced and a lug passes around the stationary support; while the lugs cooperate with the support to provide excellent detenting of the band, the lugs offer resistance to the smooth advance of the band to a different selected position. Moreover, sometimes such lugs have a tendency to shear off after having been advanced repeatedly about the stationary support.

SUMMARY OF THE INVENTION

The invention relates to a simple, readily manufacturable printing apparatus which eliminates certain deficiencies in the prior art without sacrificing the advantages. One specific embodiment of the invention is illustrated as having a printing band with a printing section and a non-printing human readable section, with lugs on the underside of the non-printing section and knurling on the underside of the printing section. The printing band meshes with a drive wheel which has both notches and knurling on its peripheral surface. Normally, only the human readable section of the printing band with its large lugs will be in mesh with the drive wheel and the human readable characters will be visible to the user who is able to see what printing character is at the printing zone. It sometimes happens that the user moves the non-printing human readable section to the printing zone. By means of the invention, in the event the user advances the printing band to a position in which the non-printing section is at the printing zone, the knurling on the wheel will provide sufficient traction between the drive wheel and the printing band to enable the printing band to be returned to a position in which the printing section is at the printing zone so that the lugs will again be in mesh with the notches in the drive wheel. The knurling on the underside of the printing section will not interfere with the advance of the printing band around the associated stationary support. The knurling on the printing band is preferably constructed and arranged so as to cushion the printing character at the printing zone during printing. In other embodiments of the invention the drive wheel is provided with both notches and knurling, and the printing section of the band has a smooth underside which can pass readily around a stationary support. The printing band of the various embodiments is especially adapted to be used with a stationary support but it can also be used with a movable support such as a square wheel.

BRIEF DESCRIPTION OF THE DRAWINGS

FIG. 7 is an elevational view similar to FIG. 1, but showing an alternative embodiment of the invention;

FIG. 8 is an enlarged fragmentary view of the printing band and wheel shown in FIG. 7, with the printing band being in a different relative position to the wheel;

FIG. 9 is a view taken along line 9—9 of FIG. 7; and

FIG. 10 is a perspective view of a wheel in accordance with another embodiment of the invention.

DETAILED DESCRIPTION OF THE PREFERRED EMBODIMENTS

Figures 1, 2, 3, 4, 5, 6:
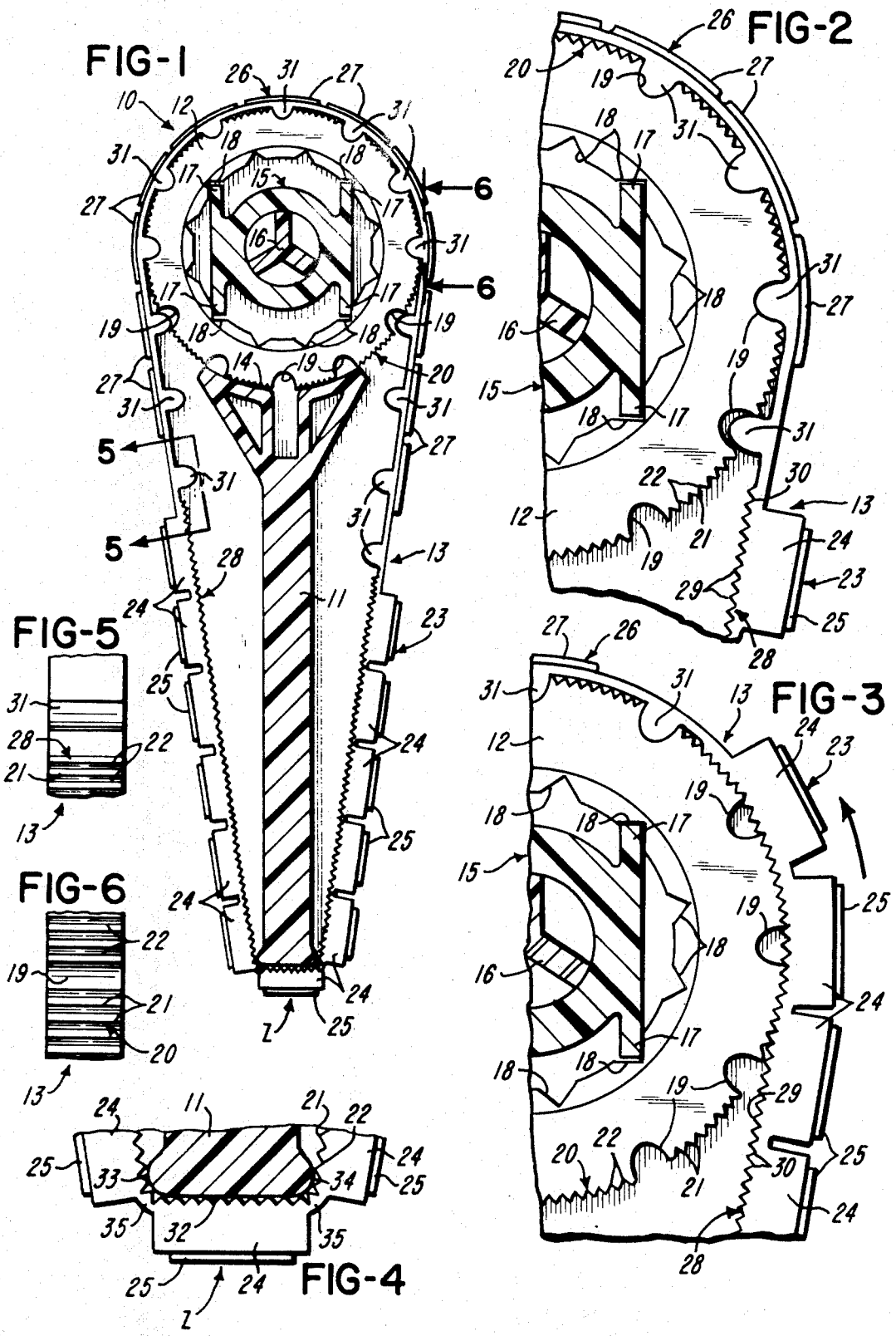
FIG. 1 is an elevational view of selective printing apparatus having a printing band, a drive wheel and a support.
FIG. 2 is an enlarged fragmentary view of the printing band and wheel shown in FIG. 1, with the printing band being in a different position relative to the wheel.
FIG. 3 is a view similar to FIG. 2, but showing the printing band in still a different position relative to the wheel.
FIG. 4 is an enlarged fragmentary view of the printing band and support shown in FIG. 1.
FIG. 5 is a view taken along line 5—5 of FIG. 1.
FIG. 6 is a view taken along line 6—6 of FIG. 1 showing a fragmentary portion of the drive wheel but omitting the printing band.

Referring to the embodiment of FIGS. 1 through 6, and initially to FIG. 1, there is shown selective printing apparatus generally indicated at 10 having a support 11, a rotatable drive wheel 12 and a printing band generally indicated at 13. The drive wheel 12 is supported for rotation by an arcuate bearing surface 14 of the support 11, and as such the printing band 13 is under slight tension. The drive wheel 12 can be driven in either clockwise or counterclockwise directions as viewed in FIG. 1 by rotation of a selector 15 which is rotatably mounted on a support 16. The selector 15 has four lugs 17 which are received in respective notches 18 on the inner surface of the wheel 12. A support similar to the support 11 and a selector the same as the selector 15 are shown in greater detail in U.S. application Ser. No. 206,061 filed Dec. 8, 1971, assigned to the same assignee as the present application, the disclosure of which is incorporated by reference. The support 11 actually supports a plurality of drive wheels 12 and the selector 15 can be moved into driving cooperation with respect to any selected one of the drive wheels as shown in application Ser. No. 206,061.

The drive wheel 12 is shown to have a plurality of uniformly angularly spaced large notches 19 at its peripheral surface. The peripheral surface of the wheel 12 is also shown to have knurling generally indicated at 20 adjacent the notches 19. The knurling 20 comprises projections in the form of uniformly angularly spaced straight, parallel, transverse ridges 21 and grooves 22.

The printing band 13 has a printing section generally indicated at 23 having printing blocks 24 with printing elements or print faces 25 and a non-printing human readable section 26 with corresponding human readable indicia 27. The underside of the printing section 23 is provided with knurling generally indicated at 28. The knurling 28 comprises projections in the form of straight, parallel, transverse ridges 29 and grooves 30. The underside of the printing band 13 beyond the knurling 28 is provided with relatively large lugs or teeth 31. The lugs 31 have the same pitch as the notches 19 and accordingly mesh exactly with the notches 19. The ridges 21 and associated grooves 22 of the wheel 12 are generally V-shaped in construction and have the same pitch as the ridges 29 and grooves 30 which are also generally V-shaped in construction. Thus, in the embodiment of FIGS. 1 through 6, projections in the form of ridges 29 and grooves 30 comprise relatively small lugs in comparison with the relatively large lugs 31; the ridges 21 and associated grooves 22 of the wheel 12 serve as lugs or teeth which can mesh with the ridges 29 and grooves 30 which serves as lugs or teeth on the underside of the printing section 23 as best shown in FIG. 3.

In using the selective printing apparatus 10, and assuming that the selector 15 is in driving cooperation with the selected drive wheel 12, the user will turn the selector 15 in either clockwise or counterclockwise directions depending upon which one of the printing blocks 24 is desired to be brought to a printing zone generally indicated at Z adjacent surface 32 of the support 11. The human readable indicia 27 opposite the printing block 24 at the printing zone Z will be visible to the user. The notches 19 and lugs 31 provide excellent traction for the printing band 13 irrespective of which one of the printing blocks 24 is brought to the printing zone Z. In the event that the user attempts to drive the wheel 12 so far that a lug 31 is no longer in mesh with the notch 19 then the knurling 20 can engage the knurling 28 at the underside of the printing section 23 under sufficient traction to enable the printing band to be returned to the position in which a notch 19 can again mesh with a lug 31.

It is apparent from FIG. 4 that the knurling 28 serves the additional purpose of providing a resilient cushion for the printing block 24 at the printing zone Z. In that the knurling 28 provides ridges or lugs 21 which are considerably smaller in size than the lugs 31, it is apparent that the knurling 28 does not interfere with advance of the printing band upon rotation of the wheel 12. The surface 32 of the support 11 extends the length of the printing block 24 and merges smoothly at each end with rounded corners 33 and 34. The corners 33 and 34 are disposed opposite respective hinges 35 which integrally connect adjacent printing blocks 24 to each other. This construction of the support 11 and the printing blocks 24 and hinges 35 makes the printing band 13 self-detenting.

Referring to the embodiment of FIGS. 7, 8 and 9, the same reference characters are used to designate like components as in the embodiment of FIGS. 1 through 6. The printing band **13*a* in the embodiment of FIGS. 7, 8 and 9 differs from the printing band 13 in that the underside of the printing section 24 is smooth and uninterrupted instead of knurled. Although in this embodiment there is no cushioning of the printing block 24 which is at the printing zone Z, the resistance to advance of the printing band 13*a* offered by the support 11 is less than in the embodiment of FIGS. 1 through 6. In the event the printing section 23 is brought into engagement with the wheel 12 and a notch 19 no longer meshes with a lug 31, then the knurling 20 on the wheel 12 contacts the underside 28*a* of the printing band 13 with sufficient friction to enable the band 13*a* to be returned to the position in which a notch 19 can again mesh with a lug 31.**

A drive wheel **12*b* shown in FIG. 10 can be substituted for the drive wheel 12 in the embodiment of FIGS. 7, 8 and 9. The drive wheel 12*b* is the same as the drive wheel 12 except that the knurling 20*b* takes the form of intersecting ridges 21*a* and grooves 22*a* shown to be a diamond knurl. The knurling 20*b* is the preferred type of knurling with a printing band such as the band 13*a* in the event the drive wheel 12*b*** is constructed of metal. This type of knurling is easy to form on a metal drive wheel as by a rolling process.

The printing bands 13 and **13*a* of the above embodiments are preferably formed by molding using any suitable flexible resilient material, such as rubber or plastic. If desired, the printing bands 13 and 13*a* can be provided with strands of flexible material such as nylon or fabric extending through the hinges 35 and base portions of the printing blocks 24.**

By way of example, not limitation, there are 50 lugs 19 and five lugs 31 per inch of band length, the height of a ridge 21 is about 0.010 inch, the included angles of the grooves 22 are about 90°, and the height of a lug 31 is about 0.028 inch. It is to be understood that the number of ridges 21 and grooves 22 can be of any desired number but are practically between about 30 and 60 per inch of band length and the number of lugs 31 can be of any desired number but practically between about three and six per inch of band length.

The wheel 12 is preferably composed of a suitable moldable plastic material. The drive wheel 12 is easy and inexpensive to mold because of the straight, parallel, transverse construction of the ridges 21 and grooves 22.

Other embodiments and modifications of this invention will suggest themselves to those skilled in the art, and all such of these as come within the spirit of this invention are included within its scope as best defined by the appended claims.

I claim:

1. Selective printing apparatus, comprising: a stationary support disposed adjacent a printing zone, a rotatably mounted drive wheel, a printing band extending under tension about the support and the wheel, the printing band having a printing section and a non-printing human readable section, printing characters on the outer surface of the printing section, corresponding human readable indicia on the outer surface of the human readable section, only small lugs on the underside of the printing section, large lugs on the underside of the human readable section, large notches at the peripheral surface of the wheel, and small notches at the peripheral surface of the wheel between the large notches, whereby the large notches in the wheel can mesh with the large lugs to enable the selected printing character to be advanced to the printing zone while the small lugs can pass readily about the support, but in the event the printing section is brought into engagement with the wheel and a large notch in the wheel no longer meshes with a large lug then the small notches in the wheel can mesh with the small lugs to enable the band to be returned to the position wherein a large notch can again mesh with a large lug.

2. Selective printing apparatus as defined in claim 1, wherein there are between about 30 and 60 small lugs per inch of band length.

3. Selective printing apparatus as defined in claim 1, wherein there are between about thirty and sixty small lugs per inch of band length, and there are between about three and seven large lugs per inch of band length.

4. Selective printing apparatus as defined in claim 1, wherein the small lugs are generally V-shaped and the large lugs are generally arcuate.

5. Selective printing apparatus as defined in claim 1, the printing band being of unitary, endless construction, there being between about thirty and sixty small lugs per inch of band length, there being between about three and seven large lugs per inch of band length, the small lugs being generally V-shaped, and the large lugs being generally arcuate.

6. Selective printing apparatus as defined in claim 1, including means for rotatably mounting the drive wheel for rotation through 360 degrees.

7. Selective printing apparatus, comprising: a printing band having a printing section and a non-printing human readable section, printing characters formed on the outer surface of the printing section, corresponding human readable indicia on the outer surface of the human readable section, only small lugs on the underside of the printing section, and large lugs on the underside of the human readable section.

8. Selective printing apparatus as defined in claim 7, wherein the printing band is of unitary, endless construction.

9. Selective printing apparatus as defined in claim 7, wherein there are between about 30 and 60 small lugs per inch of band length, and there are between about three and seven large lugs per inch of band length.

10. Selective printing apparatus as defined in claim 7, wherein the small lugs are generally V-shaped and the large lugs are generally arcuate.

11. Selective printing apparatus as defined in claim 7, the printing band being of unitary, endless construction, there being between about 30 and 60 small lugs per inch of band length, there being between about three and seven large lugs per inch of band length, the small lugs being generally V-shaped, and the large lugs being generally arcuate.

12. Selective printing apparatus, comprising: a printing band having a printing section and a non-printing human readable section, printing characters on the outer surface of the printing section, corresponding human readable indicia on the outer surface of the human readable section, large lugs on the underside of only the human readable section, and knurling on the underside of the printing section, wherein the knurling comprises a plurality of projections smaller in size than the large lugs.

13. Selective printing apparatus as defined in claim 12, wherein the knurling comprises straight, parallel, transverse grooves and ridges.

14. Selective printing apparatus as defined in claim 12, wherein the printing band is of unitary, endless construction.

15. Selective printing apparatus as defined in claim 12, wherein there are between about 30 and 60 projections per inch of band length.

16. Selective printing as defined in claim 12, wherein there are between about 30 and 60 projections per inch of band length, and there are between about three and seven large lugs per inch of band length.

17. Selective printing apparatus, comprising: a stationary support disposed adjacent a printing zone, a drive wheel, means mounting the drive wheel for rotation through 360°, a printing band extending under tension about the support and the wheel, the printing band having a printing section and a non-printing human readable section, printing characters on the outer surface of the printing section, corresponding human readable indicia on the outer surface of the human readable section, large notches at the peripheral surface of the wheel, a plurality of small, straight, parallel grooves and ridges at the peripheral surface adjacent the large notches, the small grooves being smaller than the large notches, the small grooves and ridges extending transversely to the peripheral direction around the feed wheel, large lugs on the underside of only the human readable section for meshing with the large notches to enable the selected printing character to be advanced to the printing zone but in the event the printing section is brought into engagement with the wheel and a large notch in the wheel no longer meshes with a large lug then the small ridges at the surface of the wheel contact the underside of the printing section to enable the band to be returned to the position wherein a large notch can again mesh with a large lug.

18. Selective printing apparatus as defined in claim 17, wherein there are small lugs on the underside of the human readable section capable of meshing with the small grooves.

19. Selective printing apparatus as defined in claim 17, wherein the drive wheel is of molded plastics construction.

20. Selective printing apparatus, comprising: a printing band having a printing section and a non-printing human readable section, printing characters formed on the outer surface of the printing section, corresponding human readable indicia on the outer surface of the human readable section, only small lugs on the underside of the printing section, and large lugs on the underside of the human readable section, whereby the printing band is adapted to cooperate with a wheel having large notches and intervening small notches at its periphery and the large lugs are engageable with the large notches in one position of the band relative to the wheel and the small lugs are engageable with the small notches in another position of the band relative to the wheel.

21. Selective printing apparatus as defined in claim 20, wherein the printing band is of unitary, endless construction.

22. Selective printing apparatus as defined in claim 20, wherein there are between about 30 and 60 small lugs per inch of band length, and there are between about three and seven large lugs per inch of band length.

23. Selective printing apparatus as defined in claim 20, wherein the small lugs are generally V-shaped and the large lugs are generally arcuate.

24. Selective printing apparatus as defined in claim 20, the printing band being of unitary, endless construction, there being between about 30 and 60 small lugs per inch of band length, there being between about three and seven large lugs per inch of band length, the small lugs being generally V-shaped, and the large lugs being generally arcuate.

25. Selective printing apparatus, comprising: a printing band having a printing section and a non-printing human readable section, printing characters on the outer surface of the printing section, corresponding human readable indicia on the outer surface of the human readable section, large lugs on the underside of only the human readable section, and knurling on the underside of the printing section, wherein the knurling comprises a plurality of projections smaller in size than the large lugs, whereby the printing band is adapted to cooperate with a wheel having large notches and intervening knurling at its periphery and the large lugs are engageable with the large notches in the wheel in one position of the printing band relative to the wheel and the knurling on the band is engageable with the knurling on the wheel in another position of the band relative to the wheel.

26. Selective printing apparatus as defined in claim 25, wherein the knurling comprises straight, parallel, transverse grooves and ridges.

27. Selective printing apparatus as defined in claim 25, wherein the printing band is of unitary, endless construction.

28. Selective printing apparatus as defined in claim 25, wherein there are between about 30 and 60 projections per inch of band length.

29. Selective printing apparatus as defined in claim 25, wherein there are between about 30 and 60 projections per inch of band length, and there are between about three and seven lugs per inch of band length.

* * * * *